United States Patent [19]

Hubbard

[11] 4,070,806

[45] Jan. 31, 1978

[54] SLOPED CURTAIN WALL STRUCTURE

[75] Inventor: S. Eugene Hubbard, Niles, Mich.

[73] Assignee: Kawneer Company, Inc., Niles, Mich.

[21] Appl. No.: 781,752

[22] Filed: Mar. 28, 1977

[51] Int. Cl.[2] ..... E04B 7/00

[52] U.S. Cl. ..... 52/95; 52/97; 52/395; 52/463; 52/464; 52/729

[58] Field of Search ..... 52/90, 92, 94, 95, 74, 52/463, 464, 729, 730, 732, 395, 58, 200, 97

[56] References Cited

U.S. PATENT DOCUMENTS

| | | | |
|---|---|---|---|
| 1,192,654 | 7/1916 | Lyon | 52/395 |
| 1,605,297 | 11/1926 | Slavin | 52/95 X |
| 1,634,288 | 7/1927 | Hoefel | 52/732 X |
| 1,931,750 | 10/1933 | Blaski | 52/72 |
| 3,150,463 | 9/1964 | Nearing et al. | 52/94 X |
| 3,488,899 | 1/1970 | Schultz et al. | 52/95 X |
| 3,509,674 | 5/1970 | Birum, Jr. | 52/464 X |
| 3,769,775 | 11/1973 | Brzezinsi | 52/731 |
| 3,830,029 | 8/1974 | Vance | 52/395 |
| 3,881,287 | 5/1975 | Biebuyck | 52/732 X |
| 3,961,452 | 6/1976 | Hubbard et al. | 52/731 |

FOREIGN PATENT DOCUMENTS

| | | | |
|---|---|---|---|
| 258,900 | 5/1965 | Australia | 52/395 |
| 709,039 | 5/1954 | United Kingdom | 52/464 |

*Primary Examiner*—Alfred C. Perham
*Attorney, Agent, or Firm*—Mason, Kolehmainen, Rathburn & Wyss

[57] ABSTRACT

A sloped curtain wall structure for buildings comprises an elongated, horizontal sill including a bottom wall and at least one upstanding side wall forming a gutter designed for mounting on a supporting base structure such as a vertical wall segment or a foundation wall. An elongated baffle is interconnected with the horizontal sill and is interlocked with side walls to substantially enclose the sill above the gutter and a plurality of rafters are connected through openings in the baffle by extruded anchors to the sill and supporting structure and slope upwardly to support glazing panels mounted in the frame work. Each rafter includes a gutter and a glazing pocket aligned with the glazing pocket in the baffle for receiving and supporting the edges of a glazing panel. The integral gutters on the rafters are adapted to collect any condensation from the panels and any leakage water and direct the collected liquid through the openings in the baffle into the gutter of the elongated sill for disposal outside the building.

37 Claims, 12 Drawing Figures

FIG. 1
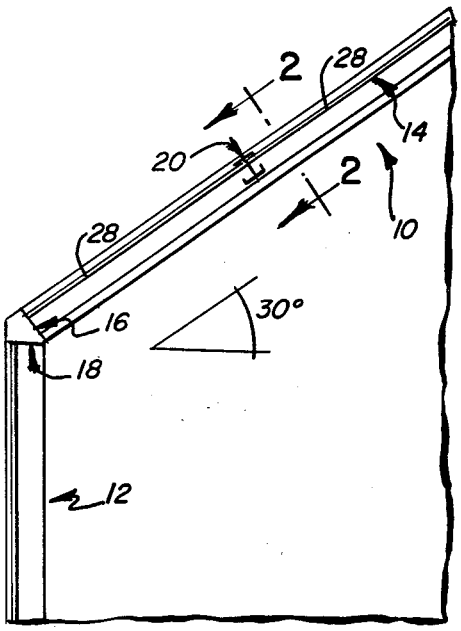
FIG. 2
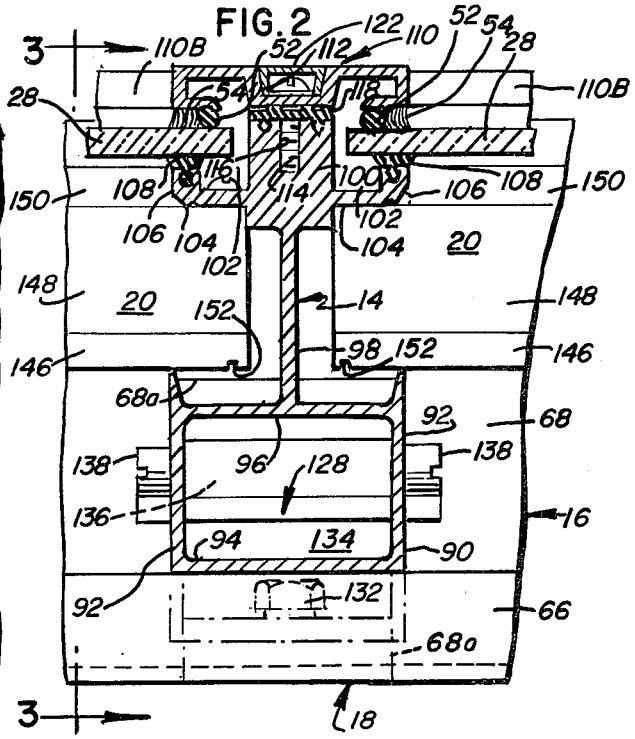
FIG. 2A
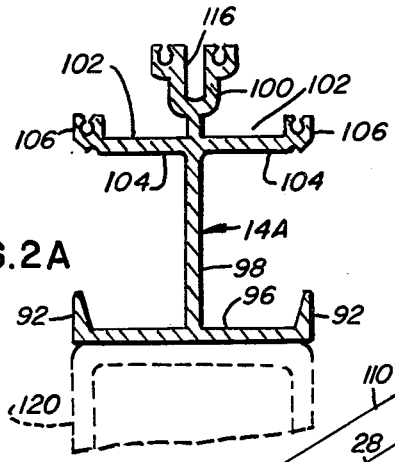
FIG. 3
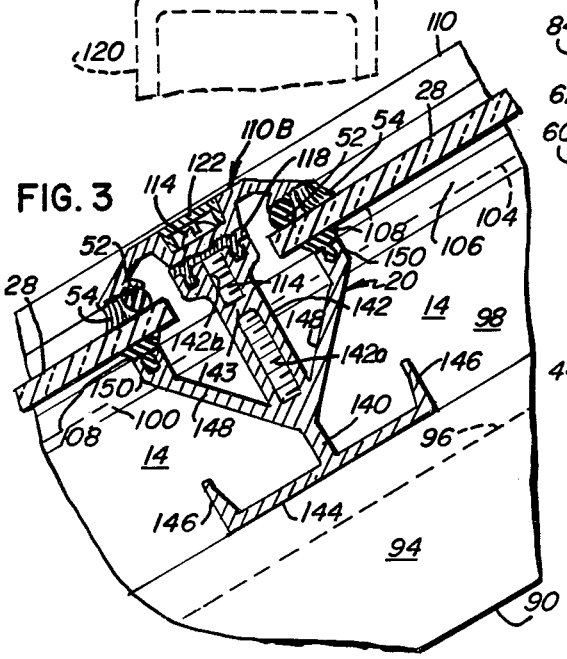
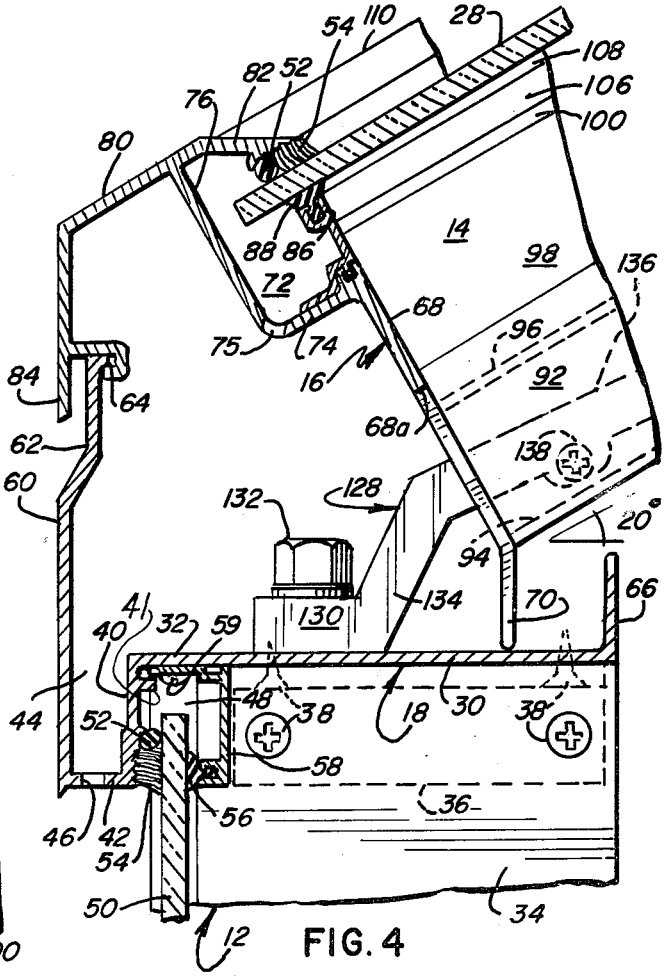
FIG. 4

FIG. 5
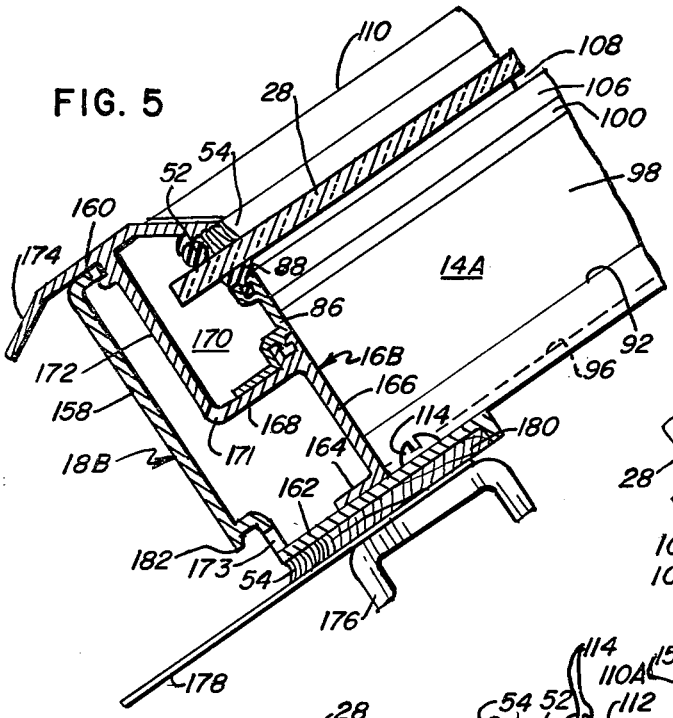
FIG. 7
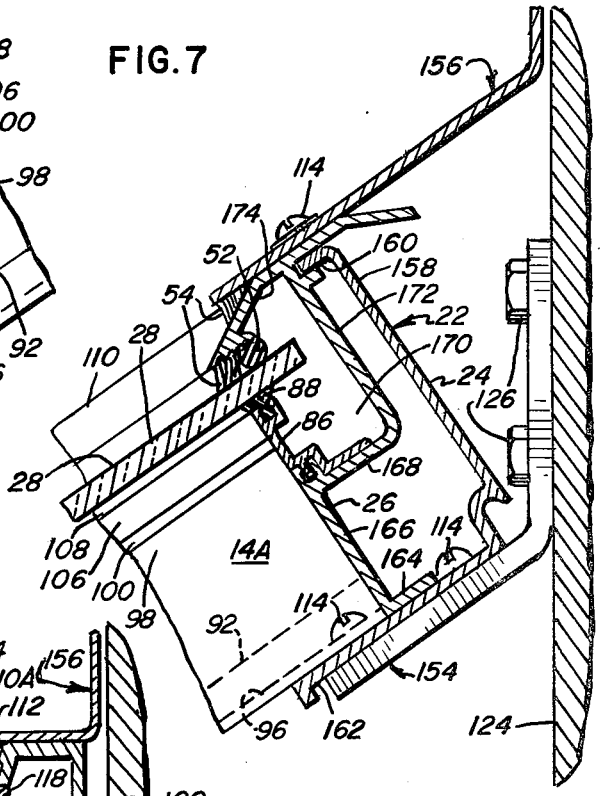
FIG. 8
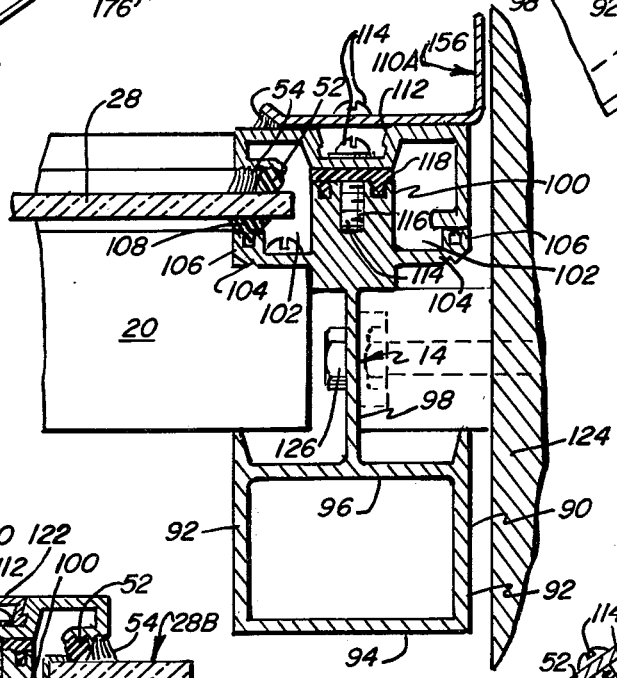
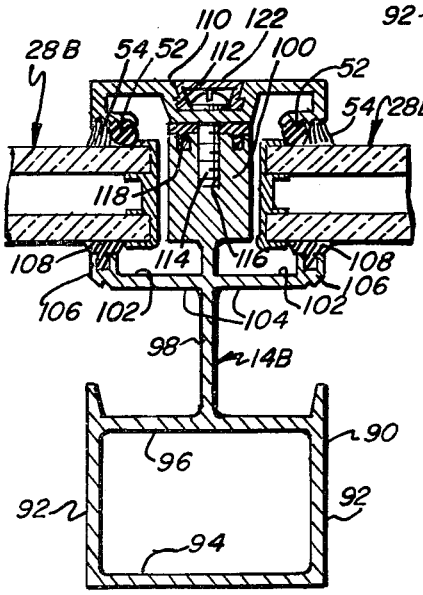
FIG. 9
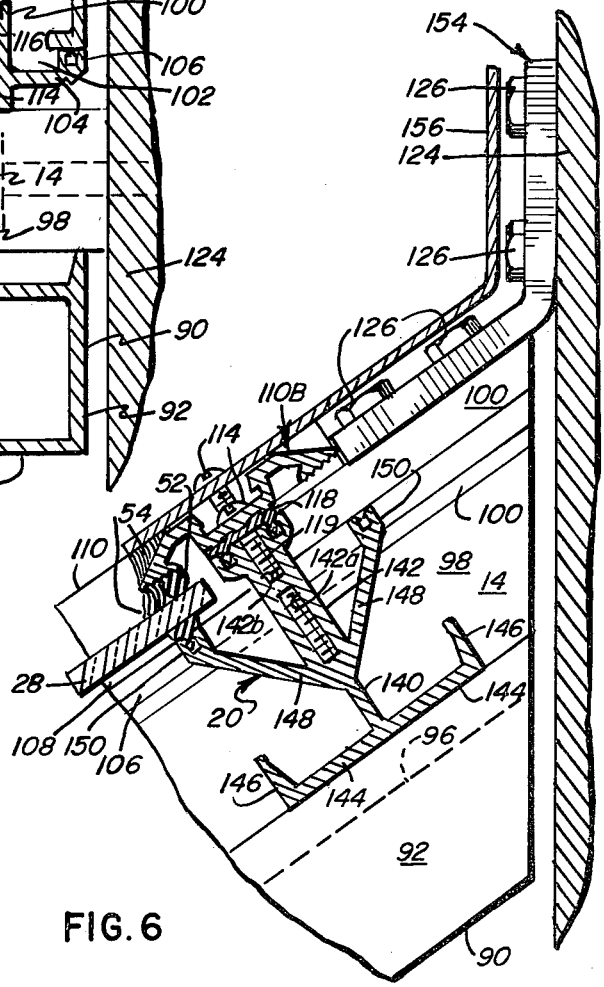
FIG. 6

SLOPED CURTAIN WALL STRUCTURE

BACKGROUND OF THE INVENTION

1. Field of the Invention

The present invention relates to a sloped curtain wall structure for buildings and the like and more particularly to a sloped curtain wall structure employing sloping rafters forming a framework for supporting glazing panels and especially adapted to be integrated with vertical curtain wall systems such as that shown in U.S. Pat. No. 3,881,276; U.S. Pat. No. 3,961,452 and U.S. Pat. No. 3,769,775, all of which patents are assigned to the same assignee as the present application.

2. Description of the Prior Art

Presently available sloped curtain wall structures having rafters forming a framework for sloped glazing panels have several problems, one of which is caused by the condensation of moisture on the underside of the glazing panels and framework. This water must be collected and disposed of along with any water that leaks in through the joints of the supporting framework and between the framework and the glazing panels. Gutter systems now provided in existing sloped curtain wall structures for making a positive collection and disposal of condensation and water leakage are often unsightly in appearance as well as being difficult to install. Another problem with existing sloping curtain wall structures is to provide a suitable transition between the sloping curtain wall, in which such gutter systems are required, and a supporting vertical wall in which the drainage gutters are differently arranged. The transition in addition to functionally supporting the sloped curtain wall structure, must also be pleasing in appearance and include means for disposal of the water collected by the gutter system of the structure.

Another problem associated with sloped curtain wall structures is the complexity of the joinery details and often a super-skilled artisan is required to understand and make the complex cuts needed for erection of the structure with a minimum of supervision. Many sloped curtain wall structures require the mitering and welding of joints between the sloped rafters and the vertical mullions of the supporting vertical wall. Besides being costly, this construction makes the disposal of infiltrated water difficult, leading to the possibility of leakage to the building interior.

It is an object of the present invention to provide a new and improved sloped curtain wall structure for buildings and the like.

Another object is to provide a new and improved sloped curtain wall structure which is especially adapted to be integrated with and compatible with a wide variety of prior art vertical curtain wall systems.

Another object of the present invention is to provide a new and improved sloped curtain wall structure wherein structurally sound transition section is provided between the sloped curtain wall portion and a supporting structure therebelow.

More particularly, it is an object of the invention to provide a unique transition section of the character described which makes provision for disposal of any condensation or leakage water carried by the gutter system of the sloped curtain wall portion.

Yet another object of the present invention is to provide a new and improved transition section for joining the vertical and sloped curtain wall sections of a building which is compact, pleasing in appearance and easy and economical to install and erect.

Yet another object of the present invention is to provide a new and improved sloped curtain wall structure of the character described having highly effective means for supporting and sealing along the edges of the glazing panels and the adjacent supporting frame work.

Yet another object of the present invention is to provide a new and improved sloped curtain wall structure having a new and improved integral gutter system which is pleasing in appearance and highly efficient in collecting and disposing of any condensation leakage water in the interior of the building.

Yet another object of the present invention is to provide a sloped curtain wall system having a horizontal sill transition section which provides a new and improved means for reducing the entry into the building interior of outside air from the weep holes.

Yet another object of the present invention is to provide a sloped curtain wall system in which water collected in the sill section is prevented from being blown into the building interior by an excess of external over internal air pressure.

Yet another object of the present invention is to provide a sloped curtain wall system having a horizontal sill transition section which provides a new and improved means for externally disposing of water collected in the internal gutter system of the sloped curtain wall structure.

Yet another object of the present invention is to provide a new and improved sloped curtain wall structure which does not require complex angular cutting of the framing member at the joints between the rafters and the sill.

Yet another object of the present invention is to provide a new and improved sloped curtain wall structure wherein several different rafter slope angles can be accommodated without requiring complex angle cutting of the frame members or other complicated joinery.

Yet another object of the present invention is to provide a new and improved sloped curtain wall structure wherein adjoining ends of sloped rafters may be square cut.

Another object is to provide a sloped wall structure wherein the live and dead load of the structure is transmitted to a vertical wall or supporting structure therebelow without the application of torque through interlocking transition members between the horizontal sill and the sloped rafters.

SUMMARY OF THE INVENTION

The foregoing and other objects and advantages of the present invention are accomplished in a new and improved sloped curtain wall structure for buildings and the like comprising an elongated horizontal sill which includes a bottom wall and a pair of upstanding side walls forming a liquid collecting gutter. The sill is adapted to be supported on a vertical wall structure or other suitable support means such as the foundation wall and in turn provides an interconnection with a sloped portion of the wall structure which includes a frame having a plurality of upwardly sloping rafters. The rafters have integrally formed gutters and a glazing pocket for receiving edge portions of glazing panels from the roof panels of the enclosure. The lower ends of the rafters are square cut and butt fitted against a horizontal baffle which provides a transition between the horizontal sill along the lower edge of the sloped wall structure. The baffle also includes an elongated glazing pocket for receiving the lower edge of the glazing panels and is positively interlocked with side walls of the sill to substantially enclose the gutter formed by the sill. Any liquid collected from the glazing panels and rafters is directed down the gutter system of the rafters through openings in the baffle into the sill and is disposed of exteriorly of the building through a plurality of weep holes or slotted openings in a lower portion of the sill.

BRIEF DESCRIPTION OF THE DRAWINGS

For a better understanding of the present invention, reference should be had to the following detailed description and claims taken in conjunction with the drawings in which:

FIG. 1 is a vertical, elevational sectional view illustrating a sloped curtain wall structure constructed in accordance with the features of the present invention;

FIG. 2 is a fragmentary cross-sectional view taken substantially along lines 2—2 of FIG. 1;

FIG. 2A is a fragmentary cross-sectional view similar to FIG. 2 illustrating an alternate form of rafter for the sloped curtain wall structure;

FIG. 3 is a fragmentary vertical sectional view taken substantially along lines 3—3 of FIG. 2;

FIG. 4 is a fragmentary large vertical transition between a vertical wall structure and the slope curtain wall structure of the present invention;

FIG. 5 is a vertical elevational view similar to FIG. 3, but illustrating a modified form of purlin construction;

FIG. 6 is an enlarged vertical sectional view illustrating the joinery and support details along the upper edge of the sloped curtain wall structure adjacent an adjoining vertical wall structure;

FIG. 7 is a vertical sectional view similar to FIG. 6 but illustrating another embodiment of the invention with a modified system interconnecting the sloped curtain wall to a vertical wall structure along the upper edge of the sloped walls;

FIG. 8 is a sectional view similar to FIG. 2, but illustrating a modified form of rafter used adjacent a vertical end wall of a building structure;

FIG. 9 is a transverse sectional view similar to FIG. 2, illustrating another embodiment of a rafter in accordance with the present invention especially adapted for use with dual glazing panels.

DESCRIPTION OF THE PREFERRED EMBODIMENTS

Figure 4A:
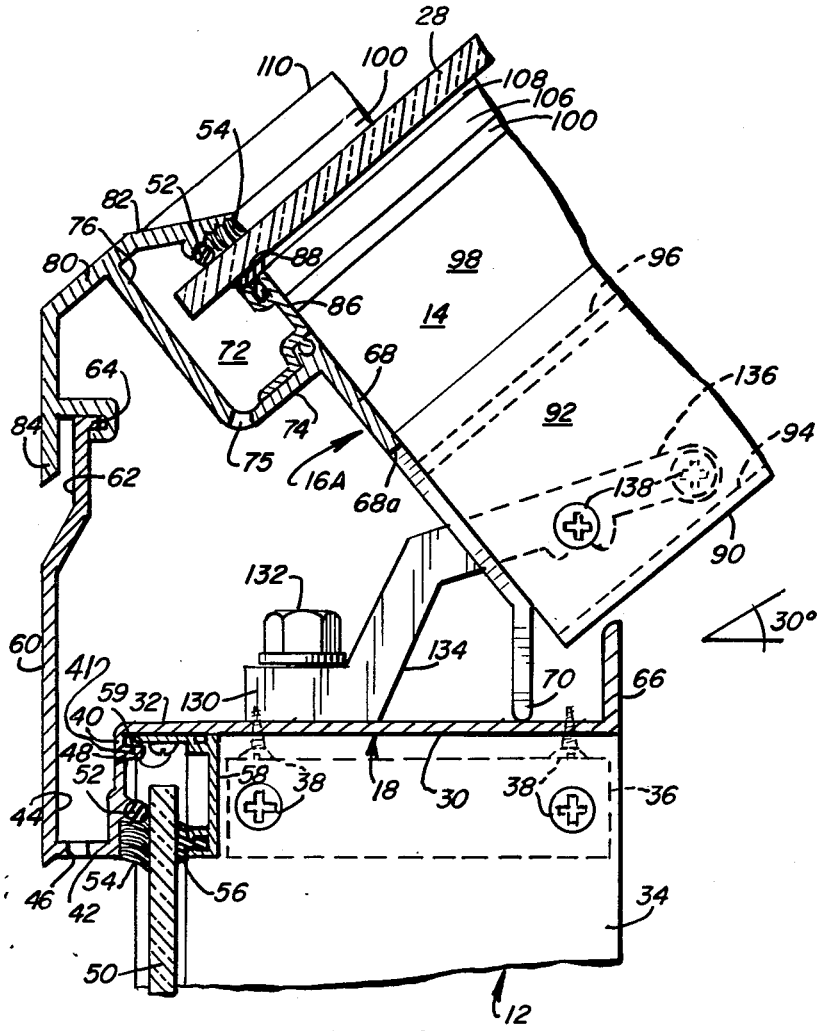
FIG. 4A is a vertical sectional view similar to FIG. 4 illustrating the constructional details of a sill and baffle wherein the rafters slope upwardly at a higher angle than the rafters in the embodiment illustrated in FIG. 4.

Referring now more particularly to the drawings, FIG. 1 illustrates a new and improved sloped curtain wall structure designated by the reference numeral 10 and adapted to be integrated into a building structure with a vertical wall section 12, for example, of the type shown and described in the aforementioned U.S. Patents, which patents are incorporated herein by reference. The sloped curtain wall structure of the present invention may also be supported on a foundation wall or other suitable support structure or beam having a horizontal surface.

In accordance with the present invention, the sloped curtain wall structure includes a structural framework comprising a plurality of upwardly sloping rafters 14 which are cut at their lower ends and are butt fitted against an elongated baffle 16. The baffle is interlocked with a sill 18 which is supported on the vertical wall section 12 or other suitable support structures. The framework may also include one or more horizontal purlins 20 interconnected at opposite ends to the rafters intermediate their end as shown in FIGS. 1 and 3. Along the upper ends of the rafters, an additional purlin may be provided as shown in FIG. 6 or a header 22 comprising a pair of interlocked members 24 and 26, may be used as shown in FIG. 7. The rafters, baffle, purlins and header are each formed with longitudinally extending glazing channels or pockets adjacent upper portions thereof in order to support and receive the edges of glazing panels 28. The glazing panels are chosen of glass or other materials having suitable thickness and strength to form the roof panels of the sloped curtain wall structure 10.

Referring now to FIGS. 4 and 4A, the sill 18 is of a generally channel shaped, transverse cross-section and includes a stepped bottom wall 30 having an upper portion 32 adapted to bear upon a suitable support structure such as the upper ends of mullions 34 of a vertical wall system 12, for example, of the type shown and described in the aforementioned U.S. Patents. The mullions and the bottom wall 32 of the sill are interconnected by means of angle clips 36 secured in place with suitable fasteners, such as the screw fasteners 38.

The stepped bottom wall 30 of the sill 18 includes a vertical wall segment 40 and a relatively narrow lower bottom wall 42 outwardly thereof and spaced lower than the upper bottom wall segment 32. The lower bottom wall and segment 40 form an outer lower gutter section 44 generally below the level of the upper wall segment 32 of the stepped bottom wall. Any moisure collected in the lower gutter section 44 is disposed of exteriorly of the building structure through a plurality of longitudinally spaced weep holes or slots 46 formed at appropriate intervals in the narrow bottom wall section 42. The vertical wall segment 40 also provides an outer stop member which forms an outside wall of a glazing pocket 48 for accommodating the upper edges of lower, vertical glazing panels 50 which may be mounted in the vertical curtain wall structure 12. From the foregoing it will be seen that the sill 18 serves a dual purpose, both as a structural member for interconnecting the upper ends of the vertical mullions 34 in the vertical wall structure 12 and as a top wall surface for the upper glazing channel 48 accommodating the panels 50. A weather strip element 52 and extruded caulking material 54 is provided adjacent the outer wall of the glazing pockets 48 to seal against the outer surface of the vertical glazing panels 50. An inside resilient sealant strip 56 is provided on the inside surface of the glazing panels and this strip is carried by a glass stop 58 which is secured to the underside of the sill 18 by suitable fasteners such as the screws 59. Alternatively, a forward edge of the upper flange of the glass stop can be interlocked within a recess formed by a rib 41 on the inside surface of the wall 40 of the sill as shown in FIGS. 4 and 4A.

In accordance with the present invention, the sill 18 includes an upstanding, generally vertical outer side wall or facia 60 projecting upwardly from the lower segment 42 of the bottom wall. The facia provides an outer gutter wall and is inset along an upper edge portion 62 which is formed with an inturned ridge 64 along the upper edge. The sill also includes an upstanding inner side wall 66 which is somewhat shorter in height than the outer side wall 60. The pair of side walls 60 and 66 and the stepped bottom wall 30 form a gutter or trough for collecting and disposal of any moisture received from the gutter system of the rafters 14. This collected water flows from the upper bottom wall section 32 into the lower gutter 44 and eventually passes to the exterior of the building through the weep openings 46.

In accordance with the present invention, the lower ends of the rafters 14 are square cut to butt fit against a main body portion 68 of the baffle 16. Along the lower edge, the main wall portion is formed with a vertical segment having a rounded lower edge which rests upon the upper surface of the bottom wall segment 32 of the sill 18 along a line spaced inwardly of the short upstanding side wall 66 as shown. Along an upper portion, the sill connector 16 is formed with a glazing pocket 72 having a bottom wall 74 perpendicular to the main body wall 68 and an upwardly sloping lower end wall 76. Weep holes 75 are provided at appropriately spaced apart intervals in the glazing pocket 72 to discharge any collected water into the main gutter formed in the sill member 18. The upper wall of the glazing pocket 72 is formed by a cap wall structure 80 integrally joined to the upper portion of the wall 76. The cap wall structure includes a downwardly and outwardly sloping top wall segment 82 having an undersurface spaced above the upper surface of the glazing panels 28 and sealed therewith by means of sealing strips 52 and caulking 54. Because of the downward and outward slope of the wall segment 82, most of the moisture tending to collect on the upper surface of the glazing panels 28 along the lower edge is directed outwardly and downwardly away from the caulking material 54. The cap wall structure 80 also includes an outer vertically extending drip edge 84 spaced outwardly from the inset portion 62 of the outer sill wall 60. The drip edge 84 discharges moisture running down over the wall to cap structure 80 outwardly away from the sill 18.

Figure 10:
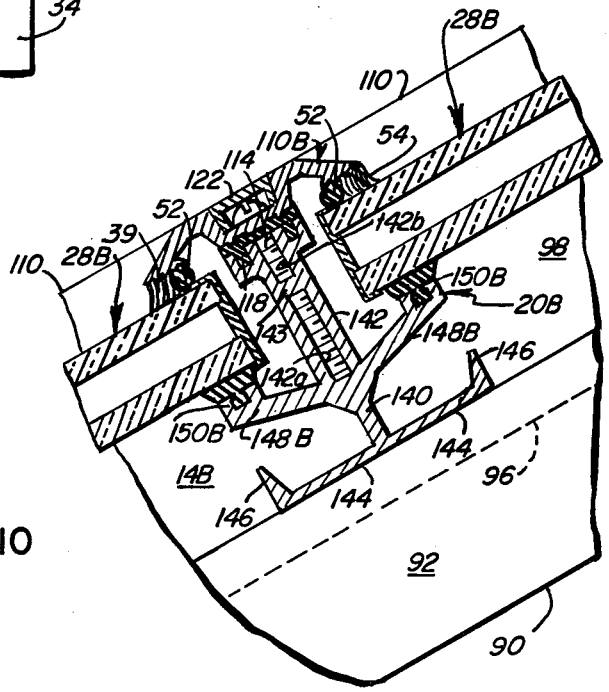
FIG. 10 is a transverse sectional view similar to FIG. 3 illustrating a modified purlin used with dual glazing panels.

The under surface of the sloped glazing panels 20 is supported in the sill connectors 16 and 16A by a snap-in filler element 86 and a sealing strip of resilient material 88 is carried along the upper edge thereof to bear against the panels. If dual glazing panels 22B of "Thermopane" or "Twindow" type glass are to be utilized in the wall structure 10 as shown in FIGS. 9 and 10, the filler strip 86 is eliminated and the lower surface of the dual glazing panels is supported simply on the sealant strip 88 which is secured in a recess adjacent the upper edge of the main body wall 68 of a sill connector 16 or 16A.

Preferably the rafters 14, the baffle 16 and the sill 18 are formed of extruded metal such as aluminum or the like. The baffle 16A is of a slightly different shape than the baffle 16 in order to accommodate the greater slope of the rafters 14 as shown in FIG. 4A.

In accordance with the invention, the rafters 14 are formed with a lower, hollow tubular structural section 90 of rectangular transverse cross-section having spaced apart, parallel vertical side walls 92 interconnected by a bottom wall 94 and a top wall 96. The top wall 96 forms the bottom of an integral rafter gutter and the side walls 92 extend upwardly above the gutter bottom to form side walls for the gutters on opposite sides of a centrally disposed upwardly extending main rafter web 98. An upper portion 100 of the rafter web is of greater thickness in order to provide additional structural strength above the neutral axis and this thickened portion forms opposite inside wall surfaces of a pair of longitudinally extending glazing channels or pockets 102 for receiving the sloping edge portions of the roof glazing panels 28. The bottom wall of the glazing channels are formed by a pair of flanges 104 extending outwardly of the web section 100 and these flanges have thickened upstanding ribs 106 along their outer edges. The ribs are formed with a recess in their upper surfaces for receiving a tongue of a resilient gasket strip 108 used for supporting and sealing adjacent the underside of the glazing panels 28.

The upper wall of the glazing pockets 102 on the rafters is formed by a removable cap member 110 having a centrally disposed, longitudinal recess 112 for accommodating a plurality of spaced apart cap screws or other threaded fasteners 114 which project downwardly into self-tapping threaded engagement within an upwardly opening central recess 116 defined in thickened upper web section 100 of the rafters. Outwardly of the central recess 112, the cap 110 is provided with lateral flange portions having inturned lower edges which bear against the sealing strips 52 and provide a surface for receiving the caulking material 54 as best shown in FIGS. 2 and 9. Between the cap member 110 and the upper surface of the thickened central section 100 of the rafter webs there is provided an insulating spacer strip 118 which is keyed into a pair of longitudinal grooves on opposite sides of the fastener receiving groove 116 in the rafter web. The cap screws 114 project downwardly through the insulating spacer 118 to secure the cap and the spacer in place. The spacer provides heat insulation between the lower surfaces of the central portion of the cap 110 and the upper surface of the thickened central section 100 of the rafter webs. The heads of the fasteners 114 are seated within the recess 112 in the cap 110 and are sealed off for protection from the weather by means of a snap-in channel shaped, strip member 122. When the snap-in strip members 122 are inserted, a finished appearance is provided for the cap.

Referring momentarily to FIG. 2A, a modified form of rafter 14A is therein shown which differs from the rafter 14 shown in section in FIG. 2 in that the tubular structural portion of the later is omitted and the structural support for the rafter 14A is provided by a separate and independent structural member 120 of the building frame work.

Referring briefly to FIG. 8, a modified cap strip 110A is provided for a rafter 14 which is to be secured adjacent an upstanding building wall 124. The rafter is mounted in place by means of a plurality of spaced anchor bolts 126 which project through the web 98 and are anchored into wall structure 124 with suitable anchoring means (not shown).

In accordance with the present invention, the live and dead load of the sloped wall structure 10 is transmitted from the sloping rafters 14 to the sill 18 independent of the baffle 16 by means of a plurality of relatively heavy metal anchor struts 128. The anchor struts 128 include a lower base portion 130 secured into the support structure of the vertical wall or a foundation wall or the like by means of spaced apart anchor bolts 132 of suitable strength to accommodate the loads involved. The struts include an intermediate, upwardly extending leg 134 and an upper leg 136 which is sloped to project into the hollow lower end of the tubular structure 92 of the rafters 14. The main body wall portion 68 of the baffle 16 and 16A is formed with a notch 68*a* (FIGS. 2 and 4) along the lower edge at the position of each rafter in order to permit the anchor struts 128 to extend upwardly and into the hollow tubular structural portion of the rafter. The anchor struts 128 are dimensioned for a width between opposite side faces substantially equal to the dimension between the inside surface of the side walls 92 of the tubular portion 90 of the rafters so that a smooth sliding fit is provided and the slots 68*a* in the wall portion 68 of the sill connectors are dimensioned to a similar width. The upper sloping leg 136 of the anchor strut is secured to opposite side walls 92 of the tubular portion 90 of the rafters by means of threaded cap screws 138 having elongated shanks which project into the integrally formed, hollow screw splines extending transversely across the upper leg 136 of the anchor struts. Thrust loads are transferred between the rafters 14 and the vertical wall mullions 12 or other foundations by the anchor struts 128 and the anchor bolts 132 independently of the baffle 16 and sill member 18.

It should also be noted that even though the angle of slope of the rafters associated with the baffles 16 and 16A of FIGS. 4 and 4A, respectively, is different, the anchor structs 128 are configured in profile to well accommodate this variation in slope and identical struts may be used for both applications. The hollow spacce between the rafter side walls 92, the top and bottom walls 96 and 94 is large enough to accommodate a range of rafter slopes in cooperation with the struts 128. It should also be noted that the upper edge of the openings or slots 68*a* formed in the main body wall 68 of the baffles is spaced above the bottom wall 96 of the gutter sections on the rafters 14 so that water collecting in the gutter sections on opposite sides of the web 98 of the rafters will spill into the gutter portion of the sill 18 and eventually drain from the sill to the weep slots or openings 46 in the lower gutter segment 44 as previously described.

Referring now to FIGS. 1, 3 and 6, the sloped curtain wall structure in accordance with the present invention may include one or more spaced apart, parallel, horizontal purlins 20 which extend transversely between the rafters 14 of the curtain wall structure. Each purlin includes a central web portion 140 having a thickened upper portion 142 formed with a hollow interior 142*a* and an upwardly opening recess 142*b* separated by a web segment 143. At the lower end of the web 140, the purlins are formed with a pair of outwardly extending bottom flanges 144 with upstanding side walls 146 along the outer edges. The flanges and outer walls form a pair of lower gutter structures for receiving and collecting condensation and liquid that forms on the under side of the glazing panels 28. As shown in FIG. 2, liquid collected in the lower gutters of the purlins is directed toward the web 98 of the rafters 14 and the water spills downwardly into the rafter gutters which are formed on opposite sides of the rafter web as by the bottom wall 96 and side walls 92. For the most part, the lower gutters of the purlins 20 serve to collect any liquid that condenses on the under side of the glazing panels 28, which liquid usually runs down the sloping panels until it reaches one of the purlins.

Each purlin is provided with a pair of upper gutters formed by a pair of wall flanges 148 which diverge upwardly and outwardly from opposite sides of the central web adjacent the juncture of the thicker upper portion 142 and the lower web portion 140. The upper gutter flange walls are formed with relatively thick upper portions 150 having a recess therein for accommodating a gasket strip 108 which supports and seals against the under side of a glazing panel 28. The upper gutter structure collects any moisture that may leak between the top cap structure secured to the upper edge of the purlins and the glazing panels. As shown, this cap structure may comprise a cap member 110B similar to the rafter caps 110 but having outer side flange portions which diverage outwardly and downwardly relative to the central body portion to sealingly engage the strips 52 and caulking 54 along the upper side of the panels 28. The caps 110B are held in place by the cap screws 114 which extend through the recessed central portion thereof and through the insulating spacer 118. The shanks of the screws are threadedly received in the upwardly opening longitudinal recess 142*b* in the thickened upper web portion 142 of the purlins. As shown in FIG. 3, the sloped side flange portion of the purlin caps 110B tends to drain off any water that might otherwise collect and remain on the upwardly facing side of the cap member and the adjacent glazing panel 28. A snap-in cover strip 122 is provided to cover over the heads of the cap screws 114 in a manner similar to that used in connection with the cap members 110 as previously described. It should be noted that the purlins 20 have a pair of upper gutter sections formed by the web portion 142 and the divergent side flanges 148 which collect water that may leak between the upper surface of the glazing panel 28 and the purlin cap member 110B. In addition, each purlin has a lower pair of gutters formed by the flanges 144 and their edge side walls 146 for collecting moisture that may condense on the under side of the glazing panels 28. It should also be noted that when the purlins are butt fitted against the rafters 14 as shown in FIG. 2, the thickened upper portions 150 of the flanges 148 are vertically square cut at a distance spaced from the cut ends of the lower portions of the flanges 148, the flanges 144 and the side walls 146. The upper portion of the square cut, butt end flanges 148 engage the thickened portion web section 100 of the rafters 14 to provide a spaced opening between the ends of the purlins and the rafter web so that water collected in the purlin gutters will pass freely into the gutter structure of the rafters. It is also to be understood that the water collected in the upper gutter sections of the purlins will first be transferred from these upper gutters into the lower purlin gutters and will then empty into the rafter gutters in a controlled flow pattern. The purlins thus provide double guttering for collecting leakage water from above and condensation on the underside of the glazing panels and in addition, provide support for the glazing panels.

The upper purlin gutters direct the collected water inwardly towards the main flange portion 142 of the purlins at a point which is spaced above the lower gutters formed by the lower flanges 144 and the side walls 146 and these lower gutters thus collect any water running out the ends of the upper gutters. In order to prevent the water discharged from the purlin gutters into the gutters of the rafters from passing back outwardly along the under side of the purlin flanges 144, each purlin flange is provided with a notch or drip cut 152 which is spaced a short distance from the adjacent purlin end to form a drip edge. It will also be noted that the thickened upper web portion 100 of the rafters 14 provides for an automatic spacing of the ends of the lower portions of the purlins to provide for good effective drainage between the gutters of the purlins and the gutter sections formed on the rafters.

Referring momentarily to FIG. 10, a modified purlin 20B is thereby illustrated and is especially adapted for accommodating dual glazing panels 28B. The purlin 20B is in most aspects similar or identical to the purlin 20 as previously described except that the outwardly and upwardly divergent flange walls 148B slope at a shallower angle away from the web 140 in order to accommodate the thicker glazing palens 28B.

Referring to FIG. 6, a purlin 20 may be utilized ajacent the upper portion of a sloped curtain wall structure which is attached to a vertical masonry wall 124 as shown. In this case, the purlin 20 serves as a header for the framing structure of the sloped curtain wall. The rafters 14 are anchored to the wall 124 by an angular strap anchor or brace 154 having a vertically extending leg secured to the outer face of the masonry or other vertical wall structure 124 by anchor bolts 126. The strap anchor 154 includes a downwardly and outwardly sloping lower leg which is adapted to be secured to support the upper ends of the rafter 14 and for this purpose, a plurality of cap screws 126 are extended through openings in the lower leg of the anchor into the central recess 116 formed in the thickened web portion 100 of the rafters. This anchoring structure as well as the cap member 110B on the purlin header 20 are covered with a suitable sheet metal flashing member 156 now having a downwardly sloping segment with a lower edge sealed to the lower side of the cap member 110B by means of caulking material 54. Similarly, an angular piece of flashing material 156 is provided as shown in FIG. 8 and the outer edge of the outwardly extending lower leg is sealed to the cap member 110A with caulking material 54. In both cases, the lower, outwardly extending leg of the flashing 156 is secured to the rafter or the purlins by means of cap screws 114 which extend into the recesses formed in the upper thickened web portions of the respective purlins and rafters.

Referring now to FIG. 7, the sloped curtain wall structure may include an upper header structure 22 instead of a single purlin 20 (as shown in FIG. 6) and the header structure is formed by a pair interfitting members 24 and 26 as shown. The upper member 24 includes an upstanding wall 158 having a lip 160 along the upper edge at right angles thereto and a base flange 162 extending outwardly and downwardly at right angles and integrally joined to the lower edge of the wall 158. The lower flange 162 is supported on the downwardly and outwardly sloping leg of the strap anchor 154 and is secured thereto by the cap screws 114. The lower leg of the strap anchor and the lower flange of the member 24 provide support for the upper ends of the rafters 14 which rest thereon. In addition, the lower flange 162 supports the lower edge of the header member 26 which includes a base 164, an upstanding wall 166 and a base 168 forming the bottom wall of a glazing pocket 170 for receiving the upper edge portion of an adjacent glazing panel 28. The glazing pocket also includes an upstanding side wall 172 which is interlocked with the upper lip 160 on the header member 24 and the upper portion of the glazing pocket is closed by an integrally formed top or cap structure 174 similar in shape to the cap member 110B and integrally joined to the upper edge of the side wall 172. The downwardly and outwardly sloping wall portion of the cap structure 174 is sealed to the upper surface of the adjacent glazing panel 28 by a sealing strip 52 and caulking material 54 and caulking material is also applied between the lower edge of the flashing member 156 and the cap structure as shown.

The glazing pocket 170 is suitable for use with a single thickness glazing panel 28 when a snap-in glazing element 86 and sealing strip 88 is provided for supporting the under side of the glazing panel. When a dual glazing panel 28B is used, the snap-in element 86 is eliminated and a sealing strip 88 is secured in place along the upper edge of the lower wall segment 166 of the member 26.

Referring momentarily to FIG. 5, when the curtain wall structure in accordance with the present invention is used in conjunction with an underlying structural tubular purlin element 176 and sloped sheet metal roofing 178, a modified form of sill 18B and baffle 16B are utilized to terminate the lower edge portion of the sloped curtain wall structure. The sill member 18B is similar to the header structure 24 of FIG. 7, and similarly the baffle 16B is similar to the element 26. The two elements are interlocked together as shown, and the cap structure 174 on the member 16B forms a drip edge on its outwardly extending downwardly sloping flange portion. The interlocked members 16B and 18B are supported on the base strip 180 which in turn is supported by an upper face portion of the purlin structure 176 and cap screws 114 extending through the flange 162 of the member 18B are provided for holding these members in place. The lower glazing pocket 170 with a bottom wall 168 and an upstanding side wall 172 is formed with a plurality of drip or weep openings 171 therein to discharge accumulated water into the lower portion of the sill structure 18B which serves as a gutter. In addition, the sill member is formed with a plurality of weep openings 173 along a lower edge portion of the upstanding wall 158 which is inset from the upper portion and a drip edge 182 is provided as shown to partially shield the weep openings 173.

From the foregoing it will be seen that the sloped curtain wall structure of the present invention provides a neatly appearing functional structure which does not require extra ordinary skill from workmen erecting the structure on site. In addition, an excellent internal guttering facility is provided for collection of the condensation on the inside of the structure and panels. Any leakage water which may get through the joints between the structural elements and the glazing panels is conducted away in an efficient manner and eventually is disposed of exteriorly of the building structure. The weep openings and baffle structure provided in the novel sill and baffle combination of the curtain wall structure restrict the air inflow in a manner preventing water from being thrown out of the collecting gutter structure along the sill.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A sloped curtain wall structure for buildings and the like comprising:

an elongated horizontal sill including a bottom wall and at least one upstanding side wall forming a gutter therein, at least one rafter sloping upwardly of said sill and including a gutter and a glazing pocket for receiving an edge portion of a glazing panel, and an elongated baffle between the lower end of said rafter and said sill including a wall portion abutting said rafter end and interlocked with said side wall of said sill to substantially enclose said sill above said gutter thereof, said baffle including a glazing pocket for receiving an edge portion of said glazing panel.

2. The sloped curtain wall structure of claim 1 wherein said sill includes a stepped bottom with a lower portion thereof adjacent an outer upstanding side wall forming said gutter.

3. The sloped curtain wall structure as in claim 1 wherein said rafter includes a vertically extended central portion forming a side wall of said glazing pocket, and a cap member detachably securable to said central portion forming an upper wall of said glazing pocket above said edge portion of said glazing panel.

4. The sloped curtain wall structure of claim 3 and an insulating spacer between said central portion and said cap member.

5. The sloped curtain wall structure of claim 1 wherein said baffle includes a cap portion forming an upper wall of said glazing pocket above said edge portion of said glazing panel.

6. The sloped curtain wall structure of claim 1 wherein said wall portion of said baffle includes an upwardly sloping segment abutting the lower end of said rafter at right angles to the longitudinal axis of said rafter.

7. The sloped curtain wall structure of claim 6 wherein said wall portion includes a lower edge portion bearing on said bottom wall of said sill to support one side of said baffle.

8. The sloped curtain wall structure of claim 6 wherein said glazing pocket of said sill connector includes a bottom wall normal to said sloping wall segment and a side wall parallel thereof.

9. The sloped curtain wall structure of claim 1 wherein said sill includes a segment along an upper edge of said upstanding side wall interlockable with an outer segment of said wall portion of said baffle.

10. The sloped curtain wall structure of claim 9 wherein said upstanding side wall is aligned with a wall of said outer segment and includes an inset segment along said upper edge.

11. The sloped curtain wall structure of claim 10 wherein said outer segment includes a drip edge spaced outwardly of said inset segment.

12. The sloped curtain wall structure of claim 1 including:

a purlin parallel of said sill having an end secured to said rafter, said purlin including at least one longitudinal glazing pocket for receiving an edge portion of said glazing panel and a gutter positioned to discharge into said gutter of said rafter.

13. The sloped curtain wall structure of claim 12 wherein said purlin includes a longitudinally extending screw receiving recess and said rafter includes at least one flange portion defining a bottom wall of said glazing pocket and adapted to overlie a portion of said screw receiving recess when said end of said purlin is secured to said rafter, said screw receiving recess adapted to receive at least one screw fastener for securing said purlin to said rafter and extending through said flange portion and threadedly engaged in said screw receiving recess.

14. The sloped curtain wall structure of claim 12 wherein said rafter includes a stop surface spaced outwardly of a vertical web portion thereof for engaging said end of said purlin to maintain an open space between said purlin and said web for permitting discharge from said gutter of said purlin into said gutter of said rafter.

15. The sloped curtain wall structure of claim 13 including a cap member securable above said purlin by at least one screw fastener, said purlin including a second screw receiving recess aligned with said first mentioned recess for receiving said fastener from said cap member.

16. The sloped curtain wall structure of claim 15 wherein said rafter includes a longitudinal screw receiving recess and including a cap member securable above said rafter by at least one screw fastener extending into said screw receiving means of said rafter.

17. The sloped curtain wall structure of claim 15 including an insulating spacer between said cap member and said purlin.

18. The sloped curtain wall structure of claim 15 including an insulating spacer between said rafter and said cap member thereabove.

19. The sloped curtain wall structure of claim 15 wherein said first and second screw receiving recesses are vertically spaced apart by a transverse wall, said second screw receiving recess open along an upper edge and a portion of said transverse wall being removed adjacent said rafter end to expose said first mentioned recess for receiving said screw fastener extending through said flange portion of said rafter.

20. The sloped curtain wall structure of claim 12 wherein said purlin includes a central web and a first gutter at the lower edge of said web on opposite sides thereof and a second gutter spaced above said first gutter on opposite sides of said web below said glazing pocket.

21. The sloped curtain wall structure of claim 20 wherein said second gutter includes a pair of walls sloping upwardly and outwardly of said web having upper edges defining lower edges of said glazing pocket.

22. The sloped curtain wall structure of claim 21 wherein said walls of said second gutter slope above a horizontal plane with a lowest point thereof adjacent said web.

23. The sloped curtain wall structure of claim 2 wherein said lower portion of said stepped bottom of said sill includes an upstanding wall placed inwardly of said outer upstanding side wall and forming a glazing stop for a glazing panel below said sill.

24. The sloped curtain wall structure of claim 23 wherein said sill includes an inner upstanding side wall extending above said stepped bottom wall forming a side wall for a gutter portion defined above said stepped bottom wall and in communication with said lower portion of said gutter of said sill.

25. The sloped curtain wall structure of claim 1 wherein said rafter includes a hollow tubular structural portion below said glazing pocket, and a wall of said tubular portion forming a bottom wall of said gutter.

26. The sloped curtain wall structure of claim 25 wherein said tubular portion includes an upstanding wall extended above said bottom wall forming a side wall of said gutter.

27. The sloped curtain wall structure of claim 25 wherein said rafter includes a vertical web extending upwardly of said tubular portion and forming a side wall of said glazing pocket and a flange extending outwardly of said web forming a bottom wall of said glazing pocket above said gutter.

28. The sloped curtain wall structure of claim 27 including:

a purlin parallel of said sill having one end secured to said rafter, said purlin including at least one longitudinally extending glazing pocket for receiving an edge portion of a glazing panel and a gutter below said pocket positioned to discharge from said one end into said gutter of said rafter.

29. The sloped curtain wall structure of claim 28 wherein said web includes a lower portion and an upper portion having a stop surface offset from said lower portion for abutting against an end surface of said purlin to assure an open space between an outer end surface of said purlin and said lower portion of said web.

30. The sloped curtain wall structure of claim 25 wherein said wall portion of said baffle is formed with an opening aligned with and in communication with said tubular structural portion of said rafter for receiving a discharge of collected moisture from said gutter of said rafter.

31. The sloped curtain wall structure of claim 30 including an anchor extending through said opening into said tubular structure of said rafter and secured at opposite end portions to said sill and said rafter for transmitting loads between the latter and the former, independent of said baffle.

32. The sloped curtain wall structure of claim 31 wherein said tubular structure of said rafter includes spaced apart vertical side walls, said opening of said wall portion having side edges aligned with said side walls of said tubular section, said anchor including opposite side surfaces dimensioned to abutt and secured to inside faces of said tubular section side walls.

33. The sloped curtain wall structure of claim 32 wherein said anchor includes a rafter portion extending into said tubular section of said rafter having a thickness less than the spacing between upper and lower walls of said tubular section permitting different angles of slope of said rafter.

34. The wall structure of claim 1 wherein said rafter includes a second gutter spaced above said first mentioned gutter thereof below said glazing pocket.

35. The wall structure of claim 34 wherein said rafter includes a vertical web portion extending between said first mentioned gutter and said second gutter, said second gutter including a wall extending outwardly on opposite sides of said web forming bottom walls of said glazing pocket.

36. The wall structure of claim 35 wherein said web of said rafter includes an upper edge portion having a screw shank receiving longitudinal recess therein and a cap member adapted to overlie said upper edge portion of said web forming an upper wall of said glazing pocket and adapted to be secured to said rafter with screw fastener means extending into said recess.

37. The wall structure of claim 36 wherein said cap member includes a portion on one side of said web extending downwardly to bear against a wall of said second gutter.

* * * * *